United States Patent [19]

Kakino et al.

[11] Patent Number: 5,069,132

[45] Date of Patent: Dec. 3, 1991

[54] WATER-IN-OIL TYPE EMULSION EXPLOSIVE ENVELOPE

[75] Inventors: Shigeru Kakino; Tatsushi Nakamura, both of Chita; Toshinori Tamari, Konan; Masao Takahashi, Chita, all of Japan

[73] Assignee: Nippon Oil and Fats Company, Limited, Tokyo, Japan

[21] Appl. No.: 629,561

[22] Filed: Dec. 18, 1990

[30] Foreign Application Priority Data

Jan. 10, 1990 [JP] Japan ..... 2-506[U]

[51] Int. Cl.[5] ..... F42G 3/00

[52] U.S. Cl. ..... 102/331; 102/332; 102/431; 149/2

[58] Field of Search ..... 149/2; 102/431, 331, 102/332

[56] References Cited

U.S. PATENT DOCUMENTS

| | | | |
|---|---|---|---|
| 3,921,529 | 11/1975 | McKee | 102/24 R |
| 4,052,939 | 10/1977 | Simmons et al. | 102/24 R |
| 4,656,948 | 4/1987 | Tsukiuda et al. | 102/452 |
| 4,790,890 | 12/1988 | Miller | 149/2 |
| 4,867,920 | 9/1989 | Sudweeks et al. | 149/2 |
| 4,942,817 | 7/1990 | Ikeda et al. | 149/2 |

*Primary Examiner*—Edward A. Miller

*Attorney, Agent, or Firm*—Stevens, Davis, Miller & Mosher

[57] ABSTRACT

A water-in-oil type emulsion explosive envelope comprises a water-in-oil type emulsion explosive and a paper wrapping the explosive. In this envelope, the paper is coated with a low-temperature melt resin and wrapped double so as to adhere joint faces to each other through heat.

3 Claims, 1 Drawing Sheet

WATER-IN-OIL TYPE EMULSION EXPLOSIVE ENVELOPE

BACKGROUND OF THE INVENTION

1. Field of the Invention

This invention relates to a water-in-oil type emulsion explosive envelope, and more particularly to a water-in-oil type emulsion explosive envelope which prevents the folding or bending of the envelope, loosening of a wrapping paper and the like.

2. Related Art Statement

Since the water-in-oil type (hereinafter abbreviated as W/O type) emulsion explosives contain water, they are high in the safeness as compared with the conventional dynamite and also tend to enhance performances as compared with a slurry explosive containing water, so that they are widely used.

As a wrapping material in the conventional W/O type emulsion explosive envelopes, there were used coated papers such as waxed laminate paper obtained by laminating an extrusion polyethylene film onto a surface of a paper as a substrate and a paraffin coating on the other surface thereof, double-laminated paper obtained by laminating extrusion polyethylene films on both surfaces of the paper and the like. These coated papers were used by wrapping the paper double by means of a cylinder forming machine.

An example of the latter case will be described with reference to the accompanying drawing.

In FIG. 3 is shown a sectional view of a part of the wrapped paper in the conventional W/O type emulsion explosive envelope.

This example shows the use of a coated paper obtained by laminating an extrusion polyethylene film 4 on each surface of a paper 5 and wrapping it double.

Since such a conventional coated paper is used, the W/O type emulsion explosive envelope is excellent in the humidity resistance.

However, the conventional W/O type emulsion explosive envelopes have problems that the folding or bending as well as the loosening of the wrapped paper are caused though the humidity resistance is excellent. Particularly, there is caused a problem that the wrapped paper is loosened in a water springing portion at an explosive inserting and blasting site. It is needless to say that the insertion of the explosive envelope into the blasting hole is obstructed when the explosive envelope is folded or bent.

SUMMARY OF THE INVENTION

The inventors have made various studies in order to overcome the aforementioned problems from various viewpoints and found that these problems can be solved by rendering the wrapping portion of the W/O type emulsion explosive envelope into a particular structure, and as a result the invention has been accomplished.

According to the invention, there is the provision of a water-in-oil type emulsion explosive envelope comprising a water-in-oil type emulsion explosive and a paper wrapping the explosive, characterized in that said paper is coated at at least one surface thereof with a low-temperature melt resin and wrapped double so as to adhere joint faces to each other through heat.

BRIEF DESCRIPTION OF THE DRAWINGS

The invention will be described with reference to the accompanying drawings, wherein:

FIG. 2*b* is an enlarged section view of the wrapping paper shown in FIG. 2*a.

DESCRIPTION OF THE PREFERRED EMBODIMENTS

Figure 1A:
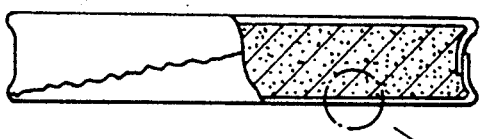
FIG. 1*a* is a front view partly shown in section of an embodiment of the explosive envelope according to the invention.

The W/O type emulsion explosive used in the invention includes all of the conventionally known W/O emulsion explosives.

The W/O type emulsion explosive usually consists of a carbonaceous fuel as a continuous phase, an aqueous solution of oxidizing acid salt as a discontinuous phase and an emulsifier and may include microcushions, a sensitizer and the like in accordance with use purpose.

The W/O type emulsion explosive is usually manufactured at a relatively high temperature of 70°-95° C.

In the wrapping material used in the invention, a paper is a substrate and includes, for example, a groundwood kraft paper, a ribbed kraft paper, semi-bleached kraft paper, bleached kraft paper and the like. This paper has generally a basis weight of 40-100 g/cm$^2$. When the basis weight of the paper is less than 40 g/cm$^2$, the explosive envelope is flexible and tends to be folded or bent even when using at a double wrapped state, while when it exceeds 100 g/cm$^2$, the paper is held up in the automatic cylinder forming machine and the like to cause various troubles and also it becomes disadvantageous in view of economic reason. Moreover, the effect of humidity resistance as in the conventional technique can be developed by laminating an extrusion polyethylene film onto a one-side surface or both side surfaces of the paper.

According to the invention, there is used a coated paper obtained, for example, by directly applying a low-temperature melt resin to the above paper or by applying such a resin to the laminated surface of the paper. The term "low-temperature melt resin" used herein means a resin melting , for example, at a temperature of about 50°-95° C. and capable of heat-sealing between the wrapped joint surfaces. As the low-temperature melt resin, mention may be made of hot melt resins each consisting essentially of an ethylene-vinyl acetate copolymer such as Bontex, trade name, made by Nippon Seiro Kabushiki Kaisha, Dicmelt, trade name, made by Dainippon Ink & Chemicals, Inc., Hirodain, trade name, made by Hirodain Kogyo Kabushiki Kaisha and the like and containing a viscosity depressant, a tackifier, a blocking agent and the like.

Moreover, resins melting at a temperature of lower than 50° C. are usually pressure type and adhere under pressure even at room temperature, so that it is required to use a releasing paper in the formation of roll paper, and also the roll paper tends to adhere by the self-weight in summer season during storing. On the other hand, with resins melting at a temperature of higher than 95° C. it is required to use another heat source because the temperature in the production of the W/O type emulsion explosive is usually 80°-90° C., so that it becomes disadvantageous in view of the equipment and the running cost.

The low-temperature melt resin is applied by means of an applicator such as gravure coater, roll coater or the like. The amount of the resin coated is usually about 5-30 g/m$^2$. When the amount is too small, the effect of preventing the folding or bending of the explosive envelope is decreased and also the adhesion strength between the sealed surfaces lowers to bring about a tendency of decreasing the effect of preventing the loosening of the wrapping paper. When the amount is too large, the effect by the increase of the coating amount is not obtained and the wrapping operability for the explosive inversely lowers.

A concrete example of such a coated wrapping paper will be described with reference to FIGS. 2*a* and 2*b*.

Figure 2A:
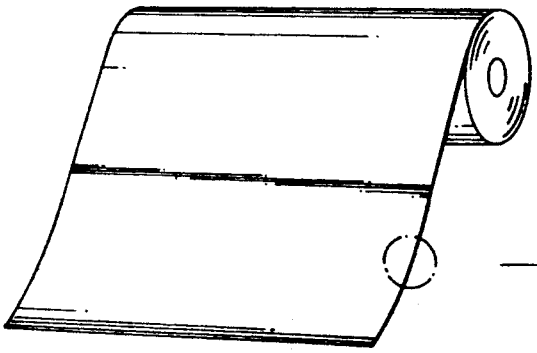
FIG. 2*a* is a perspective view of an embodiment of a wrapping paper used in the invention.
Figure 2B:
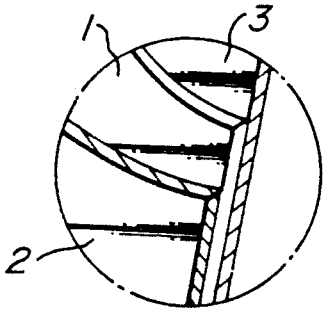
Figure 3:
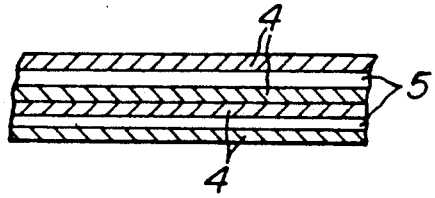
* and FIG. 3 is an enlarged section view of a part of a wrapping paper in the conventional W/O type emulsion explosive envelope.

In FIGS. 2*a* and 2*b* is shown an example of the wrapping paper used in the invention, wherein FIG. 2*a* is a perspective view of the wrapping paper and FIG. 2*b* is an enlarged section view thereof.

In FIGS. 2*a* and 2*b*, numeral 1 is a kraft paper as a substrate, numeral 2 a polyethylene film laminated on the one-side surface of the paper, and numeral 3 a low-temperature melt resin applied to the other side surface of the paper.

Such a coated paper is used as follows. That is, the wide coated paper is first cut to a given width. The cut roll-like coated paper is fed to a cylinder forming machine, where the cutting, winding and bottom forming are conducted. Thereafter, the W/O type emulsion explosive is filled in the resulting cylinder, and then an upper portion of the cylinder is sealed to form an explosive envelope. Moreover, since the W/O type emulsion explosive is warmed at about 70°-95° C., the low-temperature melt resin is melted through heat conduction in the filling and sealing steps and adhered to the joint face of the wrapped paper to form a complete seal.

In this case, if the temperature is low, heat may be supplied from an external heat source.

Alternatively, the W/O type emulsion explosive is once cooled and shaped into a given form, which is wrapped with the coated paper. Thereafter, the joint faces of the wrapped paper at the seal position may be adhered to each other by heating.

The heating temperature is usually about 50°-95° C.

Figure 1B:
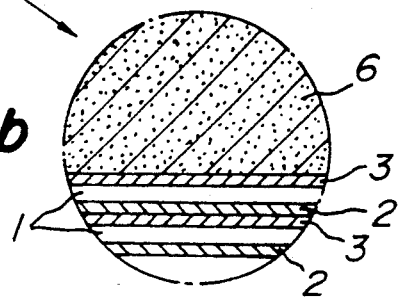
FIG. 1*b* is an enlarged view in the vicinity of a wrapping material shown in FIG. 1*a;*

In FIGS. 1*a* and 1*b* is shown an embodiment of the W/O type emulsion explosive envelope according to the invention, wherein FIG. 1*a* is a front view partly shown in section of the envelope and FIG. 1*b* is an enlarged view in the vicinity of the wrapped material.

In FIG. 1*b*, numeral 1 is a kraft paper, numeral 2 a laminated polyethylene film, numeral 3 a low-temperature melt resin, and numeral 6 a W/O type emulsion explosive.

As shown in FIG. 1*b*, the laminated polyethylene film 2 located in the central portion of the wrapped material is completely adhered to the lower kraft paper 1 through the low-temperature melt resin 3.

According to the invention, the coated paper coated with the low-temperature melt resin is used as a wrapping paper and the joint faces of the coated paper to be wrapped are adhered to each other through heat, so that the prevention from the folding or bending of the W/O type emulsion envelope and the loosening of the wrapped paper is considerably improved as compared with the conventional explosive envelope. Furthermore, heat produced in the production of the W/O type emulsion explosive itself can be utilized, so that the adhesion of joint faces can be carried out without requiring special a heat source. Moreover, there is no influence of the low-temperature melt resin on the explosion performances.

The following examples are given in illustration of the invention and are not intended as limitations thereof.

EXAMPLE 1

A coated paper was manufactured by extrusion laminating a low density polyethylene resin of 15 μm in thickness onto a surface of a groundwood kraft paper having a basis weight of 70 g/m$^2$ and a width of 1000 mm and applying a low-temperature melt resin of Dicmelt DX-11C made by Dainippon Ink & Chemicals, Inc. to the other surface of the kraft paper in an amount of 15 g/m$^2$ by means of a gravure coater. Then, this wide coated paper was cut to a width of 297 mm to form a paper roll. This paper roll was fed to an automatic cylinder forming machine, where the paper roll was cut into a lozenge and wound so as to render the low-temperature melt resin onto an inner face to from a cylinder of 30 mm in diameter and at the same time a bottom of the cylinder was formed. In the paper cylinder was filled 200 g of a W/O type emulsion explosive of 85° C. and the upper portion of the cylinder was sealed, which was transferred to multi-packaging step through a cooling step for decreasing the temperature of the W/O type emulsion explosive to cause solidification of the low-temperature melt resin.

After the thus obtained W/O type emulsion explosive envelope was taken out, the adhesion state of the low-temperature melt resin to the surface of the laminated polyethylene film was observed, and consequently the joint surfaces were completely adhered and integrated with each other.

When the explosive envelope was charged into water and subjected to vibrations for 10 minutes and then taken out from water, there was observed no change in the wrapped material.

When this explosive envelope was initiated by the usual initiating method, there was observed no degradation of explosion performances and the like.

EXAMPLE 2

A W/O type emulsion explosive envelope was manufactured in the same method as in Example 1 except that a coated paper obtained by extrusion laminating high density polyethylene resin of 15 μm in thickness to both surfaces of a ribbed kraft paper having a basis weight of 50 g/m$^2$ and a width 970 mm and applying a low-temperature melt resin of Bondex-1033 made by Nippon Seiro Kabushiki Kaisha to a surface of the laminated paper in an amount of 20 g/m$^2$ by means of a roll coater was used instead of the wrapped material in Example 1.

The adhesion degree in the thus obtained explosive envelope was measured, and consequently the joint faces were completely adhered to each other.

When the explosive envelope was subjected to the same water test and initiating test as in Example 1, there was observed no abnormal accident

What is claimed is:

1. A water-in-oil type emulsion explosive envelope comprising a water-in-oil type emulsion explosive and a paper wrapping the explosive, wherein said paper is coated at at least one surface thereof with a low-temperature melt resin having a melting point of 50°–95° C. in an amount of 5–30 g/m$^2$ and wrapped double so as to adhere joint faces to each other through heat.

2. The explosive envelope according to claim 1, wherein said paper is selected from the group consisting of a groundwood kraft paper, a ribbed kraft paper, semi-bleached kraft paper and bleached kraft paper and has a basis weight of 40–100 g/cm$^2$.

3. The explosive envelope according to claim 1, wherein a polyethylene film is extrusion-laminated onto at least one surface of said paper prior to said application of low-temperature melt resin.

* * * * *